US009103575B2

(12) United States Patent
Taras et al.

(10) Patent No.: US 9,103,575 B2
(45) Date of Patent: Aug. 11, 2015

(54) OPERATION AND CONTROL OF TANDEM COMPRESSORS AND REHEAT FUNCTION

(75) Inventors: Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 1778 days.

(21) Appl. No.: 12/307,756

(22) PCT Filed: Aug. 1, 2006

(86) PCT No.: PCT/US2006/029817

§ 371 (c)(1), (2), (4) Date: Jan. 7, 2009

(87) PCT Pub. No.: WO2008/016348

PCT Pub. Date: Feb. 7, 2008

(65) Prior Publication Data

US 2009/0235678 A1 Sep. 24, 2009

(51) Int. Cl.

*F25B 1/10* (2006.01)
*F25B 49/02* (2006.01)
*F24F 3/153* (2006.01)

(52) U.S. Cl.

CPC ..... *F25B 49/022* (2013.01); *F24F 3/153* (2013.01); *F25B 2400/075* (2013.01); *F25B 2400/13* (2013.01); *F25B 2500/06* (2013.01); *F25B 2600/0251* (2013.01); *F25B 2700/15* (2013.01); *F25B 2700/1931* (2013.01); *F25B 2700/1933* (2013.01); *F25B 2700/21151* (2013.01); *F25B 2700/21152* (2013.01)

(58) Field of Classification Search

CPC ..... F25B 49/022; F25B 2400/075
USPC ..... 62/127, 196.4, 510
See application file for complete search history.

(56) References Cited

U.S. PATENT DOCUMENTS 2,295,775 A 9/1942 Crittenden
2,549,547 A * 4/1951 Trask ..... 62/176.6
4,220,010 A * 9/1980 Mueller et al. ..... 62/126
4,947,655 A * 8/1990 Shaw ..... 62/200

(Continued)

FOREIGN PATENT DOCUMENTS

JP 2003-860377 A 11/2003

OTHER PUBLICATIONS

Search Report and Written Opinion mailed on Apr. 5, 2007 for PCT/US06/29817.

(Continued)

*Primary Examiner* — Jonathan Bradford
(74) *Attorney, Agent, or Firm* — Carlson, Gaskey & Olds, PC

(57) ABSTRACT

A refrigerant system control operates tandem compressors. If one of the monitored system conditions does not change as each of the tandem compressors or associated components is brought on line, then a determination is made that the respective component is malfunctioning. A refrigerant system can also be additionally equipped with other functions and components, such as variable speed drive, economizer circuit, unloader bypass, and reheat circuit. In case of a reheat circuit, the system can have single or multiple compressors. The control algorithm can also be updated such that that particular malfunctioning component is eliminated from the operational sequence.

18 Claims, 2 Drawing Sheets

(56) References Cited

U.S. PATENT DOCUMENTS

| | | | | |
|---|---|---|---|---|
| 6,644,066 | B1 * | 11/2003 | Dolcich | 62/509 |
| 6,701,723 | B1 * | 3/2004 | Dobmeier et al. | 62/90 |
| 6,718,781 | B2 * | 4/2004 | Freund et al. | 62/199 |
| 6,981,383 | B2 | 1/2006 | Shah et al. | |
| 2004/0060305 | A1 | 4/2004 | Singh et al. | |
| 2004/0221591 | A1 * | 11/2004 | Lifson et al. | 62/196.2 |
| 2004/0261431 | A1 * | 12/2004 | Singh et al. | 62/125 |

OTHER PUBLICATIONS

Notification Concerning Transmittal of International Preliminary Report on Patentability mailed for PCT/US2006/029817.

* cited by examiner

OPERATION AND CONTROL OF TANDEM COMPRESSORS AND REHEAT FUNCTION

This application is a United States National Phase application of PCT Application No. PCT/US2006/029817 filed Aug 1, 2006.

BACKGROUND OF THE INVENTION

This application relates to refrigerant systems having enhancement features and extended functionality. Further, this application relates to refrigerant systems incorporating multiple compressors, such as tandem compressors, that may include an economizer cycle, a bypass circuit and a variable speed drive, as well as to refrigerant systems incorporating a reheat function, and wherein a control algorithm is utilized to provide diagnostic and prognostic information with regard to each of these enhancement features.

Heating, ventilation, air conditioning and refrigeration (HVAC&R) systems are utilized to condition various environments. The HVAC&R systems typically use a refrigerant circulating throughout a closed-loop circuit and are applied as air conditioners, heat pumps, refrigeration units, etc. Various enhancement techniques and system configurations are known and implemented to provide a required performance over a wide spectrum of environmental conditions to satisfy diverse thermal load demands.

In a very basic refrigerant system, a compressor compresses a refrigerant and delivers it downstream to a condenser. Refrigerant passes from the condenser to an expansion device, and from the expansion device to an evaporator. From the evaporator, refrigerant returns to the compressor. This basic system is typically supplemented and enhanced by a number of different options and features to satisfy application requirements.

One such enhancement is the use of tandem compressors. Tandem compressors include a plurality of compressors each receiving refrigerant from a common suction manifold, each separately compressing the refrigerant and delivering the refrigerant to a common discharge manifold. Each of these compressors may be independently turned on or off to vary refrigerant system capacity. In this manner, the capacity provided by the compressor subsystem to the overall refrigerant system can be tailored to the thermal load demands in the conditioned space. Quite often, tandem compressor configurations include oil and vapor equalization lines for functionality and reliability enhancement.

Another option to vary refrigerant system capacity, which can be used within a tandem compressor arrangement, includes the use of a compressor unloading function. One commonly employed compressor unloading function may selectively deliver at least a portion of compressed (partially or fully) refrigerant back to a suction line. In this manner, the amount of compressed refrigerant delivered through the refrigerant system is reduced when a part-load capacity is demanded. Other compressor unloading schemes are also known in the art. As known, compressor unloading may be used outside tandem compressor applications as well.

Another performance enhancement feature, which can be employed with tandem compressors, is the use of a variable speed drive to vary the speed of the compressor motor. By providing a variable frequency control for varying the compressor motor speed, the amount of the compressed refrigerant delivered throughout the system can be varied accordingly. Again, this allows the refrigerant system designer to tailor the provided capacity to a desired capacity demand. As above, a variable speed compressor may be used outside tandem compressor arrangements.

One other option of performance boost for a refrigerant system, which can be incorporated within tandem compressor subsystems, is the use of an economizer cycle. The economizer cycle selectively taps a portion of the refrigerant downstream of the condenser and upstream of the expansion device, and passes that tapped refrigerant to a separate economizer expansion device. This tapped partially expanded refrigerant is then utilized to cool a refrigerant circulating through the main circuit in an economizer heat exchanger. By providing this extra subcooling, the capacity and/or efficiency of the refrigerant system are increased. As known, an economizer cycle can employ a single compressor or multiple compression stages operating in sequence. Once again, this performance enhancement feature can be used outside tandem compressors as well.

Another optional refrigerant system feature, which may or may not be used in conjunction with the tandem compressors, is a reheat function. In a reheat cycle, refrigerant, which is warmer than the refrigerant flowing through the evaporator, is directed through a reheat heat exchanger positioned on the refrigerant path upstream of the evaporator. The air to be conditioned may be cooled (and dehumidified) in the evaporator to a temperature below than desired. That air then passes over the reheat heat exchanger where it is warmed back to the target temperature. However, having been overcooled in the evaporator, the air would have much lower moisture content than if it had only been cooled to the target temperature. Various reheat system configurations are known in the HVAC&R industry, and this invention is not intended to reference to any particular schematic, but rather refers to a generic mechanical dehumidification reheat concept utilizing primary refrigerant circulating throughout a refrigerant system. Once again, the reheat function can be used outside tandem compressor applications.

Various diagnostic features are known in the prior art. However, the prior art has not provided a system for diagnostic and prognostic features based on staged operation of compressors and other associated system components, when anyone of the several tandem compressors or other associated system components, may be experiencing a problem. Further, controls for optimizing refrigerant system operation when one of the tandem compressors may be running in an undesirable manner (e.g., outside the specified envelope), have also not been provided.

SUMMARY OF THE INVENTION

In some of the disclosed embodiments of this invention, a refrigerant system has tandem compressors and may also include an additional performance enhancement feature such as an economizer cycle, a bypass circuit, a variable speed drive or a combination of thereof. In some other embodiments the refrigerant system can include a reheat function enhancement feature, where the reheat function can be associated with just a single compressor or with multiple compressors. In the disclosed embodiments a control algorithm is utilized to provide diagnostic and prognostic information with regard to these enhancement features. In one disclosed embodiment, a refrigerant system having tandem compressors is operated and controlled in a way to run at least one of the tandem compressors independently. As each of the tandem compressors is turned on, various system operating parameters are monitored. These parameters may include pressures and temperatures measured at the compressor system suction and discharge manifolds. For instance, suction pressure is expected to fall and discharge pressure is expected to rise when another tandem compressor is turned on. If the system operating conditions do not change outside the tolerance band, as would be expected as each particular compressor comes online, then this particular compressor is identified as being a malfunctioning compressor. While a warning signal may be issued for the maintenance to be performed, the present invention also updates control algorithms such that a particular compressor is eliminated from a control sequence for operating the tandem compressors to provide a demanded capacity.

Similar diagnostic features can be utilized with tandem compressors that are additionally equipped with an unloader function, and/or variable speed drive for the compressor motor and/or with an economizer function. All these features can be used separately or in combination with one another. In the disclosed embodiment, when the unloader function is activated, the suction pressure is expected to rise and discharge pressure is expected to drop, as well as discharge temperature is expected rise. Consequently, an appropriate transducer placed at any of these locations should detect the respective change above the predetermined tolerance band. If this does not occur, the unloader function is considered malfunctioning. Obviously, more than one compressor of the tandem compressors may be equipped with the unloader function.

In still another embodiment, when an economizer function is activated, the suction pressure should decrease and the discharge pressure should increase, as well as the discharge temperature should decrease. Once again, if this change in operational parameters is not occurring, one of the components of the economizer branch is malfunctioning. It has to be noted that more than one compressor may be equipped with the economizer function, and these compressors may or may not share other auxiliary economizer branch components such as the economizer heat exchanger and economizer expansion device.

In yet another embodiment, a variable speed compressor malfunctioning would be identified if the suction pressure does not decrease and/or discharge pressure does not rise while the compressor speed is ramped up.

In another embodiment, the initiation of the reheat function, which may or may not be associated with the tandem compressors, would typically correspond to both a discharge and suction pressure reduction. If this change is not observed, then there is a malfunctioning component within the reheat branch.

Additionally, if the corresponding system operating parameters and changes in these parameters, while a respective refrigerant system component is turned on or shut down, are monitored over time, conclusions regarding degradation of each of the abovementioned components, features or options can be drawn and preventive measures can be taken to avoid failures. Furthermore, if a certain function is activated (for instance, another tandem compressor is turned on) and a refrigerant system operates outside the specified envelope, corrective measures (such as activating an unloader function or deactivating an economizer function) can be taken to return the refrigerant system operation within a "safe" region.

These and other features of the present invention can be best understood from the following specification and drawings, the following of which is a brief description.

DETAILED DESCRIPTION OF THE PREFERRED EMBODIMENTS

Figure 1:
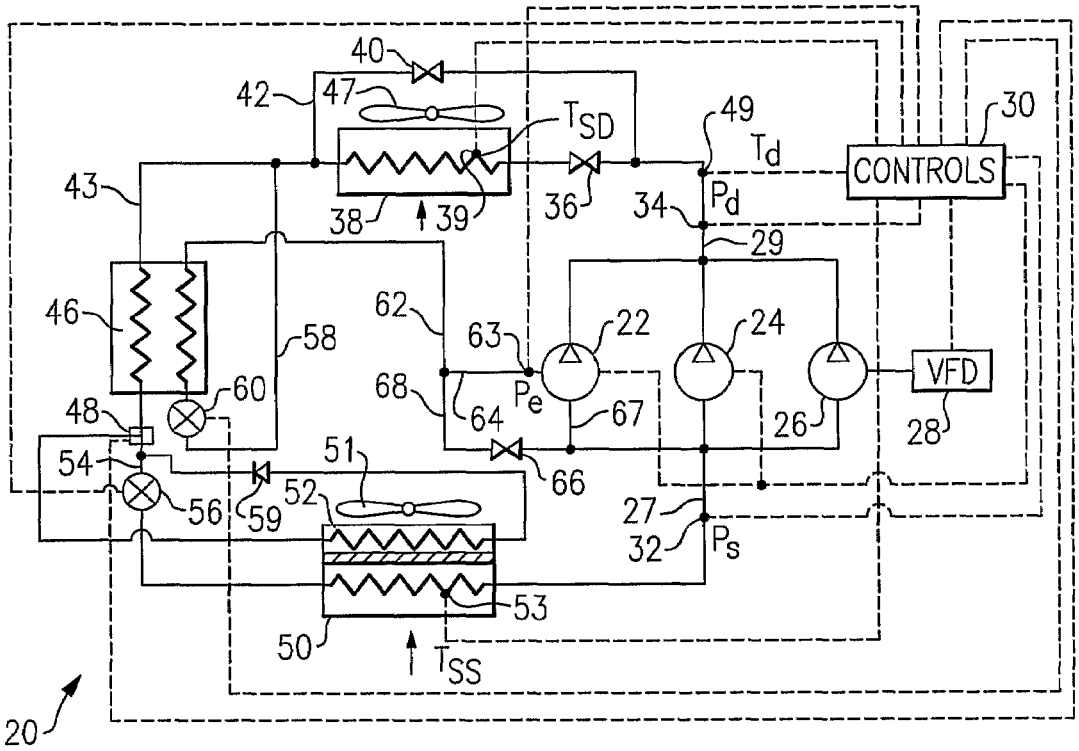
FIG. 1 is a schematic view of an inventive refrigerant system.

FIG. 1 illustrates a refrigerant system 20 showing tandem compressors incorporating the present invention. It should be noted that this system, as shown in this Figure, has optional features that include an economized cycle (an economizer heat exchanger, an economizer expansion device and associated piping), an unloader option (an unloader valve and associated piping), a reheat function (a reheat heat exchanger, and associated valves and piping), and variable speed option with variable frequency drive (VFD). All these features can be selectively added to the main embodiment of having tandem compressors, independently or in conjunction with other options. As shown in FIG. 1 these options are combined with each other, but any number of them can also be removed if so desired. Compressors 22, 24 and 26 all deliver refrigerant from a common suction manifold 27 to a common discharge manifold 29. As illustrated, compressor 26 may be provided with an optional variable frequency drive 28 for operating its motor at a varying speed. In this manner, the total capacity provided by the combination of compressors 22, 24 and 26 may be exactly tailored to a desired capacity to satisfy comfort conditions in the indoor environment.

A suction pressure sensor 32 and a discharge pressure sensor 34 are illustrated on the manifolds 27 and 29 respectively and typically are already incorporated into the refrigerant system 20 for other control purposes. Alternatively, temperature sensors 53 and 39 may be utilized to measure saturation temperatures corresponding to a suction and discharge pressure respectively. Additionally, a discharge temperature sensor 49 can be employed as well. As is known, refrigerant compressed by the tandem compressor bank is delivered downstream to a condenser 38. A temperature sensor 39 is shown within the two-phase region of the condenser 38. A valve 36 selectively allows or blocks flow of refrigerant to the condenser 38. Further, a bypass line 42 and a bypass valve 40 allow at least a portion of refrigerant to bypass the condenser 38. The condenser 38 is cooled by air, driven by a condenser fan 47. The condenser bypass and reheat function (explained below) are typically activated to provide dehumidification with little or no cooling being performed on air delivered into an environment to be conditioned.

An economizer heat exchanger 46 is positioned downstream of the condenser 38. As shown, a tap line 58 selectively taps a portion of the refrigerant to an economizer expansion device 60, and then through the economizer heat exchanger 46. A main flow of refrigerant in a liquid line 43 exchanges heat with this tapped refrigerant. Since the tapped refrigerant in a line 58 is passed through the economizer expansion device 60 and expanded to a lower pressure, it is also at a relatively low temperature and can further cool the refrigerant in the liquid line 43. This provides a greater cooling potential when the main circuit refrigerant reaches a downstream evaporator 50. Refrigerant from the tap line 58 passes through a line 62, into a vapor injection line 64 and to an intermediate compression point in the compressor 22. It has to be noted that various configurations and flow arrangements exist for the economizer cycle and will equally benefit from this invention. Further, more than one tandem compressor can be provided with the economizer function, and these tandem compressors may or may not share the same economizer branch components such as the economizer heat exchanger 46 and the economizer expansion device 60.

A reheat circuit is also incorporated into the refrigerant system 20. As shown, a three-way valve 48 (as known, for example, the three-way valve can be substituted by a pair of solenoid valves) selectively directs refrigerant through a reheat heat exchanger 52 and a check valve 59. The reheat heat exchanger 52 is positioned in the path of air having moved over the evaporator 50, by an evaporator fan 51. The evaporator fan 51 moves the air over evaporator 50, and over the reheat heat exchanger 52. As known, by utilizing the reheat heat exchanger with a refrigerant that is hotter than the refrigerant having passed through the evaporator 50, a reheat circuit allows for significantly higher dehumidification capability, accompanied by cooling, heating or neutral sensible capacity of the air delivered to the conditioned space. Generally, in any reheat mode of operation, the evaporator is utilized to overcool the air to a temperature below a desired temperature in an environment conditioned by the refrigerant system 20. This allows removal of more moisture than would be removed if the air were only cooled to the target temperature. The air then passes over the reheat heat exchanger 52 at which it is warmed back to the target temperature. Refrigerant having passed through the reheat heat exchanger 52 is returned at point 54 into the liquid line 43 of the main refrigerant circuit. Refrigerant then passes through a main expansion device 56, and to the evaporator 50. From the evaporator 50, the refrigerant returns to the compressor suction manifold 27.

The control 30 receives input signals from the various pressure and/or temperature sensors and controls various components within the refrigerant system 20.

In a disclosed embodiment of this invention, the control is operable to selectively bring online any of the compressors 22, 24 and 26 or any combination of thereof, as well as the various operation enhancement features to achieve a desired sensible and latent capacity. In a main feature of this invention, each of the tandem compressors 22, 24 and 26 is brought online at separate instances in time to satisfy thermal load demands in the conditioned space. If the suction pressure sensed by the pressure sensor 32 does not decrease when the next tandem compressor is brought online, then that compressor is flagged as having a problem. Similarly, if the discharge pressure sensed by pressure sensor 34 does not increase when the next tandem compressor is brought online, then the referenced compressor is malfunctioning. As, known, temperature sensors 53 and 39 respectively positioned within the two-phase region of the evaporator 50 and condenser 38 can be used instead. The warning signal may be issued by the refrigerant system control 30 indicating that maintenance of a corresponding compressor is required. Further, the control 30 is operable to execute its control algorithm not to rely on a compressor 22, 24 or 26 which has been identified as being potentially faulty or in need of maintenance. Thus, the present invention allows not only diagnosing a malfunctioning tandem compressor but also altering the control for the refrigerant system 20 so as to eliminate any potentially problematic compressor of the tandem compressor bank from the operational control sequence.

As known, tandem compressors need to have at least one common manifold. For instance, if tandem compressors 22, 24, and 26 have only common suction manifold 27 and separate discharge manifolds connected to separate condensers, then only the suction pressure sensor 32 (or the temperature sensor 53) can be utilized for diagnostic and control purposes. On the other hand, if tandem compressors 22, 24, and 26 have only common discharge manifold 29 and separate suction manifolds connected to separate evaporators, then only the discharge pressure sensor 34 (or the temperature sensor 39) can be employed by the refrigerant system control 30 for diagnostics and operation control.

An unloader line 68 incorporating a bypass valve 66 selectively connects the vapor injection line 64 to the suction line 67 leading to the suction port of the compressor 22. Further, the tandem compressor 26 can be a variable speed compressor and its motor is controlled by a variable frequency drive 28, in turn controlled by the refrigerant system control 30. While only one compressor is shown with a variable frequency drive, and only one compressor is shown receiving refrigerant from the economizer cycle, and being provided with an unloader function, it should be understood that more than one compressor can be provided with any one of these features or combinations of thereof. Moreover, the economizer cycle can incorporate multiple sequential compression stages instead of a single compound compressor. Also, the tandem compressors equipped with the economizer function may or may not share other auxiliary economizer branch components such as an economizer heat exchanger and economizer expansion device.

When the unloader valve 66 is activated, the anticipated increase in the suction pressure, registered by the suction pressure sensor 32 (or the temperature sensor 53), and decrease in the discharge pressure, registered by the discharge pressure sensor 34 (or the temperature sensor 39), should be observed. If the expected changes did not take place, then the determination can be made that the unloader function is not working properly.

Analogous conclusions can be drawn when the economizer function is engaged. When the economizer function becomes operational, the anticipated increase in the discharge pressure, registered by the discharge pressure sensor 34 (or the temperature sensor 39), and decrease in the suction pressure, registered by the suction pressure sensor 32 (or the temperature sensor 53), should be observed. Once again, if the expected changes did not take place, then it can be concluded that the economizer function is not working properly. Further, if the economizer line pressure sensor 63 is available, it can also be used to determine whether the economizer and unloader functions are working properly. The economizer pressure should drop when the unloader function is engaged and increase when the economizer function is activated. Even further, an electric current sensor or electric power sensor can be utilized to determine if any of the compressors or any of the above mentioned functions has been engaged or properly activated. For example, if the compressor did not come online as expected, then the current sensor or electric power sensor would not detect the expected change in the current or power draw. Also, as mentioned above the discharge temperature sensor 49 can be used to determine the proper operation of the economizer and unloader functions. The discharge temperature, registered by the discharge temperature sensor 49, is expected to fall when the economizer function is engaged and increase when the unloader function is activated.

If the bypass around the condenser is operated, then it would be expected that the discharge pressure, measured by the discharge pressure sensor 34 (or the temperature sensor 39), would increase. If this does not occur, then one can assume that the condenser bypass function may not be operating properly. Similarly, when the reheat cycle is activated by opening the three-way valve 48, it would be expected that the suction pressure and discharge pressure, respectively registered by the pressure sensors 32 and 34 (or the temperature sensors 53 and 39), would change in accord with the selected dehumidification mode of operation. If this does not occur, once again, one can assume that the reheat function is faulty.

Similarly, the changes in the current or power draw are expected when any of these functions are engaged. If such changes do not occur then this is an indication that the reheat function is not working properly. It should be pointed out that if the system is not equipped with above mentioned optional features such as reheat, economized cycle, bypass unloading, and VFD, then in this simplest arrangement, the malfunction of any of the tandem compressors 22, 24 or 26 can be determined by monitoring changes in the system parameters when one of this compressors is called by a controller to be brought online; if no changes in the system operating conditions occur this indicates that the referenced compressor is not working properly. Then the controller takes an action to take this compressor out of the operating tandem compressor sequence.

Figure 2:
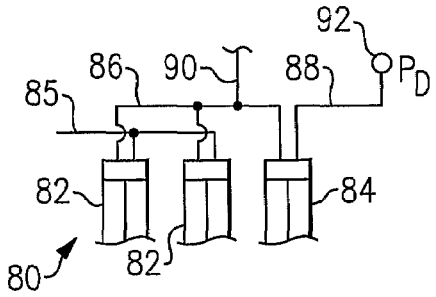
FIG. 2 is a partial view of a portion of a second embodiment refrigerant system.

FIG. 2 shows another embodiment 80 wherein the tandem compressors 82 deliver refrigerant from a suction manifold 85 to an intermediate manifold 86. The refrigerant is delivered from the intermediate manifold 86 to a second stage compressor 84 and then to a discharge line 88. The compressors may be provided with a vapor injection or liquid injection line 90, similar to the vapor injection line 64 in the first embodiment. The FIG. 2 is illustrative, and many variations in design configurations and a number of stages are possible. For instance, each of the compression stages may incorporate tandem, economized, and variable speed compressors, as well as the unloader function.

Again, system electric current, power draw or various pressures and temperatures can be sensed within this compression system 80, such as discharge pressure registered by a discharge pressure sensor 92, to assure its proper operation; and the refrigerant system control can modify operational strategy by sensing this discharge pressure to determine whether any of the compressor stages 82 and 84 is failing.

Figure 3:
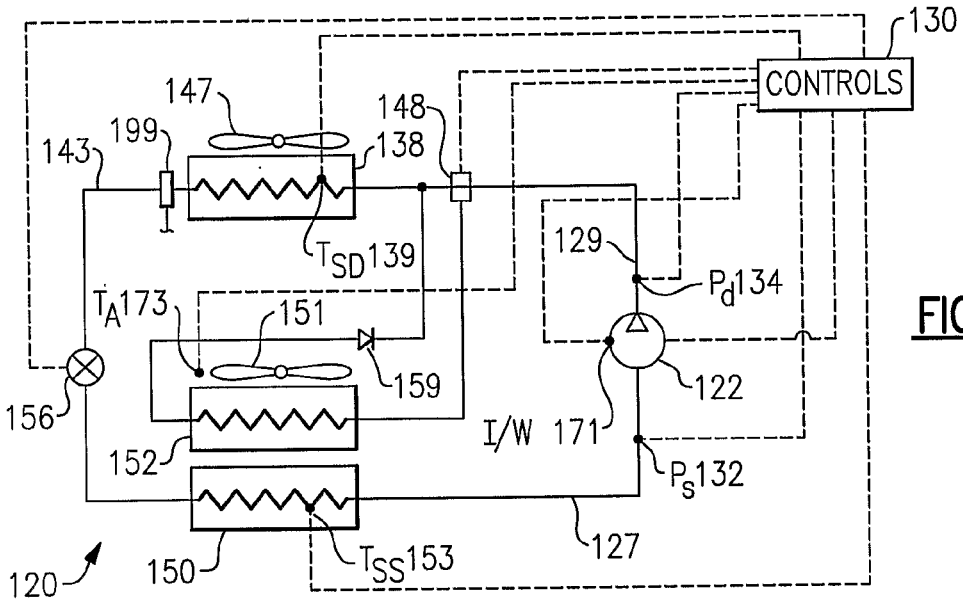
FIG. 3 is another schematic of an inventive refrigerant system.

FIG. 3 depicts another embodiment 120 of the invention, where a single compressor 122 and a hot gas reheat function are incorporated into the refrigerant system schematic. As in the FIG. 1 embodiment, suction and discharge pressure sensors 132 and 134 (or the temperature sensors 153 and 139) monitor the changes in suction and discharge pressure accordingly. Additionally, a current or power draw sensor 171 monitors compressor power consumption and a supply air temperature sensor 173 monitors temperature of the air delivered to a conditioned space. All sensors are connected to and in communication with a refrigerant system control 130. Operation and control of the refrigerant system 120 is similar to operation and control to the refrigerant system 20. When the reheat function is activated, by switching a three-way valve 148 to allow the refrigerant to flow through a reheat coil 152, certain changes are expected in system operational parameters monitored by the abovementioned sensors. When the reheat function is engaged, discharge and suction pressures, registered respectively by the discharge and suction pressure sensors 134 and 132 (or the temperature sensors 139 and 153) should decrease, current or power draw, registered by the sensor 171, should typically decrease, as well and supply air temperature, registered by the sensor 173, should increase. If the changes mentioned above are not observed, then the reheat function is not operating properly, and a corrective action is required. Obviously, it is not necessary to include all these sensors into the refrigerant system design, since their operation may be redundant, and only one sensor could serve the purpose sufficiently well. A three-way valve 148 is positioned upstream of the condenser 138, but, as shown at 199, it may also be positioned at an alternate location downstream of the condenser 138. Obviously, in the latter case, a return line from the reheat branch to the main refrigerant cycle should be also positioned downstream of the condenser 138.

Figure 4:
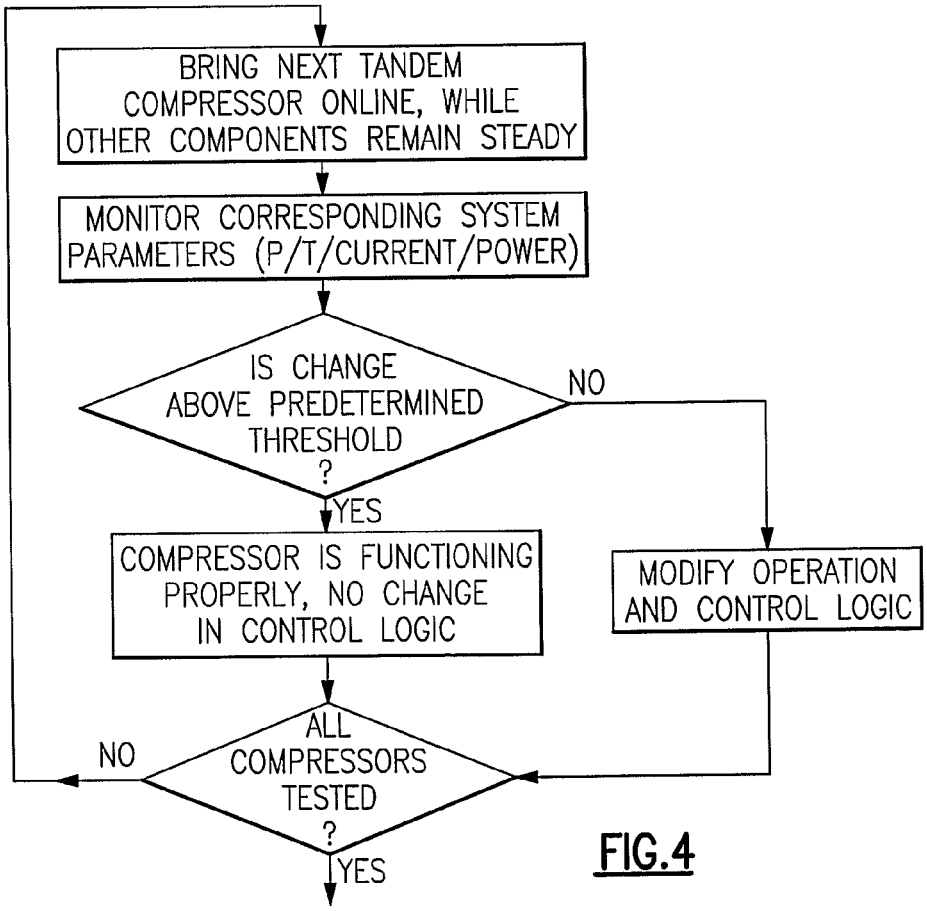
FIG. 4 is a basic flow chart of the present invention.

As an example, FIG. 4 shows a very basic flow chart of the present invention in relation to the tandem compressors. The compressors in the tandem compressor configuration are run in a serial manner at periodic intervals, such as, for instance, during system startup or shutdown, and actual changes in corresponding operational parameters are compared to the expected changes. Alternatively, when extra capacity is demanded in the conditioned space and the next compressor is to be brought online, the corresponding operational parameters are monitored and the relevant changes are observed. Other components may be operated, although this is optional. The electric current and/or power draw and/or pressures and/or temperatures are monitored at some locations within the refrigerant system, and diagnostic procedures are performed. If any one of the tandem compressors is identified as being malfunctioning, or any of the abovementioned system components is identified as being faulty, then the control program is updated to not rely upon and "bypass" the faulty components, and a warning signal is issued. It also should be noted that the tandem compressor system shown in FIG. 1 is selected for illustration purpose only, as these system can be modified to be made more complex such as, for example, by incorporating additional condensers and/or evaporators, having more than three compressors, etc. On the other hand, the tandem compressor system shown in FIG. 1 can be simplified by eliminating certain components and functions, such as, for example, a reheat function, a vapor injection function, a bypass unloading, a variable speed function or reducing a number of compressors from three to two.

Further, if the corresponding system parameters are monitored for prolonged periods of time and collected in the database or control memory, conclusions can be made regarding refrigerant system component degradation, and preventive maintenance can be performed to avoid failures. Furthermore, if a certain function is activated (for instance, another tandem compressor is turned on) and a refrigerant system operates outside the specified envelope, corrective measures (such as activating an unloader function or deactivating an economizer function) can be taken to return the refrigerant system operation into a "safe" region.

The present invention thus provides an easy method of improving control of refrigerant systems, and refrigerant systems with tandem compressors and a reheat function in particular, such that any faulty elements are eliminated from a control algorithm. Obviously, the registered changes should exceed a specified tolerance threshold that includes (but not limited to) sensor variability, system operational fluctuations, component manufacturing tolerances, etc.

Although the preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a tandem compressor bank including a plurality of compressors receiving refrigerant from a suction manifold, compressing the refrigerant and delivering the refrigerant into a discharge manifold;

a condenser positioned downstream of said compressor bank, an expansion device positioned downstream of said condenser, and an evaporator positioned downstream of said expansion device, refrigerant passing from said compressor bank to said condenser, through said expansion device to said evaporator, and back to said suction manifold; and at least one sensor for sensing a refrigerant system operating condition, and a control for being operable to monitor said operating condition as each of said tandem compressors is brought online, and identify a refrigerant system fault based upon expected changes in said operating condition as each of said tandem compressors is brought online.

2. The refrigerant system as set forth in claim 1, wherein at least one suction or discharge manifold is common for said tandem compressor bank.

3. The refrigerant system as set forth in claim 1 wherein the said refrigerant system fault is a compressor fault.

4. The refrigerant system as set forth in claim 1, wherein each of said tandem compressors is brought online serially and an expected change in operating conditions is compared to a sensed change.

5. The refrigerant system as set forth in claim 1, wherein said operating condition is one of a suction pressure and suction temperature.

6. The refrigerant system as set forth in claim 1, wherein said operating condition is one of a discharge pressure and discharge temperature.

7. The refrigerant system as set forth in claim 1, wherein said operating condition is one of an economizer pressure and economizer temperature.

8. The refrigerant system as set forth in claim 1, wherein said operating condition is one of an electric current and power draw.

9. The refrigerant system as set forth in claim 1, wherein the said tandem compressor bank includes two compressors.

10. The refrigerant system as set forth in claim 1, wherein the said tandem compressor bank includes more than two compressors.

11. The refrigerant system as set forth in claim 1, wherein said refrigerant system is also provided with a variable speed drive for at least one of said tandem compressors, and an operating condition is monitored as said variable speed drive changes the speed of a motor for said at least one tandem compressor, and said monitored condition being compared to an expected condition as said speed changes to identify said fault in said variable speed compressor.

12. The refrigerant system as set forth in claim 1, wherein a bypass is provided around said condenser, and said controller monitors a refrigerant condition as said bypass is operated to determine whether said fault is a fault in a bypass function by comparing a sensed refrigerant condition to an expected refrigerant condition.

13. The refrigerant system as set forth in claim 1, wherein an economizer cycle is incorporated into the refrigerant system, and said economizer cycle being operated and an operating condition being sensed and supplied to said control, said control comparing said sensed operating condition to an expected condition when said economizer cycle is operational and identifying said fault in the economizer function if said expected and said sensed conditions differ by more than a predetermined threshold.

14. The refrigerant system as set forth in claim 1, wherein an unloader function is incorporated into the refrigerant system, and said unloader function being operated and an operating condition being sensed and supplied to said control, said control comparing said sensed operating condition to an expected condition when said unloader function is operational and identifying said fault in the unloader function if said expected and said sensed conditions differ by more than a predetermined threshold.

15. The refrigerant system as set forth in claim 1, wherein a reheat circuit is incorporated into the refrigerant system, and said reheat circuit being operated and an operating condition being sensed and supplied to said control, said control comparing said sensed condition to an expected condition when said reheat circuit is operational and identifying said fault in the reheat function if said expected and said sensed conditions differ by more than a predetermined threshold.

16. The refrigerant system as set forth in claim 1, wherein said control updates a control algorithm such that it no longer relies upon a faulty refrigerant system component or function.

17. The refrigerant system as set forth in claim 16, wherein said faulty refrigerant system component is a compressor.

18. A method of operating a refrigerant system comprising:

providing a tandem compressor bank including a plurality of compressors receiving refrigerant from a suction manifold, compressing the refrigerant and delivering the refrigerant into a discharge manifold, a condenser positioned downstream of said compressor bank, an expansion device positioned downstream of said condenser, and an evaporator positioned downstream of said expansion device, refrigerant passing from said compressor bank to said condenser, through said expansion device to said evaporator, and back to said suction manifold; and at least one sensor sensing a refrigerant system operating condition, and a control operable to monitor said operating condition as each of said tandem compressors is brought online, and identify a refrigerant system fault based upon expected changes and sensed changes in said operating condition as each of said tandem compressors is brought online.

* * * * *

UNITED STATES PATENT AND TRADEMARK OFFICE

CERTIFICATE OF CORRECTION

PATENT NO. : 9,103,575 B2
APPLICATION NO. : 12/307756
DATED : August 11, 2015
INVENTOR(S) : Taras It is certified that error appears in the above-identified patent and that said Letters Patent is hereby corrected as shown below:

IN THE CLAIMS:

Claim 16, column 10, line 28; delete "it" and replace with --said algorithm--

Signed and Sealed this
Ninth Day of February, 2016

Michelle K. Lee

Michelle K. Lee
*Director of the United States Patent and Trademark Office*